US010264848B2

(12) United States Patent
Elder et al.

(10) Patent No.: US 10,264,848 B2
(45) Date of Patent: Apr. 23, 2019

(54) ARTICLE OF FOOTWEAR WITH INTERCONNECTED TENSILE STRANDS

(71) Applicant: NIKE, Inc., Beaverton, OR (US)

(72) Inventors: Zachary Elder, Portland, OR (US); Dervin A. James, Hillsboro, OR (US); Elizabeth Kilgore, Portland, OR (US)

(73) Assignee: NIKE, Inc., Beaverton, MS (US)

( * ) Notice: Subject to any disclaimer, the term of this patent is extended or adjusted under 35 U.S.C. 154(b) by 167 days.

(21) Appl. No.: 14/844,146

(22) Filed: Sep. 3, 2015

(65) Prior Publication Data

US 2015/0374067 A1 Dec. 31, 2015

Related U.S. Application Data

(63) Continuation of application No. 13/767,768, filed on Feb. 14, 2013, now Pat. No. 9,144,263.

(51) Int. Cl.
*A43C 11/00* (2006.01)
*A43B 13/14* (2006.01)
(Continued)

(52) U.S. Cl.
CPC ..... *A43B 13/14* (2013.01); *A43B 7/1495* (2013.01); *A43B 13/16* (2013.01);
(Continued)

(58) Field of Classification Search
CPC ..... A43B 7/1495; A43B 13/14; A43B 13/122; A43C 1/003; A43C 9/04; A43C 1/00
(Continued)

(56) References Cited

U.S. PATENT DOCUMENTS 2,495,984 A 1/1950 Roy
4,213,256 A 7/1980 Mas et al.
(Continued)

FOREIGN PATENT DOCUMENTS

CN 202335387 U 7/2012
EP 000014915-0006 8/2003
(Continued)

OTHER PUBLICATIONS

"Knot,n." dictionary.com. Web. Dec. 30, 2014.
(Continued)

*Primary Examiner* — Sally Haden
*Assistant Examiner* — Jillian K Pierorazio
(74) *Attorney, Agent, or Firm* — Honigman LLP; Matthew H. Szalach; Jonathan P. O'Brien

(57) ABSTRACT

An article of footwear includes an upper with a heel region that extends posteriorly about the heel, a medial side, and a lateral side. The article of footwear also includes a sole structure. Moreover, the article includes a longitudinal strand that extends along at least one of the medial side and the lateral side. Also, the article includes an underfoot strand that is coupled to the longitudinal strand and that extends across the sole structure to extend between the lateral side and the medial side of the upper. Furthermore, the article includes a closure strand that is coupled to the longitudinal strand. The closure strand is configured to couple to the closure element such that tensioning of the closure element tensions the longitudinal strand, the underfoot strand, and the closure strand to selectively secure the article of footwear to the foot.

20 Claims, 5 Drawing Sheets

(51) Int. Cl.

| | |
|---|---|
| ***A43C 1/04*** | (2006.01) |
| ***A43B 7/14*** | (2006.01) |
| ***A43B 13/16*** | (2006.01) |
| ***A43B 23/02*** | (2006.01) |
| ***A43C 1/00*** | (2006.01) |

(52) U.S. Cl.
CPC ..... *A43B 23/0235* (2013.01); *A43B 23/0245* (2013.01); *A43C 1/00* (2013.01); *A43C 1/04* (2013.01)

(58) Field of Classification Search
USPC ..... 36/50.1, 7.6, 103
See application file for complete search history.

(56) References Cited

U.S. PATENT DOCUMENTS

| | | | | |
|---|---|---|---|---|
| 4,366,631 | A | 1/1983 | Larsen et al. | |
| 4,592,154 | A | 6/1986 | Oatman | |
| 4,654,985 | A | 4/1987 | Chalmers | |
| 4,811,503 | A | 3/1989 | Iwama | |
| 5,003,711 | A | 4/1991 | Nerrinck et al. | |
| 5,291,671 | A | 3/1994 | Caberlotto et al. | |
| 5,371,957 | A | 12/1994 | Gaudio | |
| 5,408,761 | A | 4/1995 | Gazzano | |
| 5,463,822 | A | 11/1995 | Miller | |
| 5,678,329 | A | 10/1997 | Griffin et al. | |
| 5,692,319 | A | 12/1997 | Parker et al. | |
| 5,755,044 | A | 5/1998 | Veylupek | |
| 5,791,021 | A | 8/1998 | James | |
| 6,032,387 | A | 3/2000 | Johnson | |
| 6,052,921 | A | 4/2000 | Oreck | |
| 6,128,835 | A * | 10/2000 | Ritter | A43C 1/00 36/114 |
| 6,286,233 | B1 | 9/2001 | Gaither | |
| D456,121 | S | 4/2002 | Smith, III | |
| 6,378,230 | B1 | 4/2002 | Rotem et al. | |
| D472,041 | S | 3/2003 | Kuerbis | |
| 6,598,322 | B2 | 7/2003 | Jacques et al. | |
| 6,772,541 | B1 | 8/2004 | Ritter et al. | |
| 7,134,224 | B2 | 11/2006 | Elkington et al. | |
| D553,842 | S | 10/2007 | Paz | |
| 7,343,701 | B2 * | 3/2008 | Pare | A43C 1/06 36/50.1 |
| 7,392,990 | B2 | 7/2008 | Bussiere | |
| 7,562,470 | B2 | 7/2009 | Keen | |
| 7,568,298 | B2 | 8/2009 | Kerns | |
| 7,793,435 | B1 | 9/2010 | Ruth | |
| 8,006,410 | B2 | 8/2011 | Romboli et al. | |
| 8,074,379 | B2 | 12/2011 | Robinson, Jr. et al. | |
| D651,380 | S | 1/2012 | Wilcots | |
| 8,151,490 | B2 | 4/2012 | Sokolowski | |
| 8,215,033 | B2 | 7/2012 | Carboy et al. | |
| 8,230,618 | B2 | 7/2012 | Bruce et al. | |
| 2004/0181972 | A1 | 9/2004 | Csorba | |
| 2005/0284000 | A1 | 12/2005 | Kerns | |
| 2006/0048413 | A1 | 3/2006 | Sokolowski et al. | |
| 2007/0011910 | A1 | 1/2007 | Keen | |
| 2008/0040947 | A1 * | 2/2008 | Burgess | A43B 5/0419 36/7.6 |
| 2008/0110049 | A1 | 5/2008 | Sokolowski et al. | |
| 2009/0071041 | A1 * | 3/2009 | Hooper | A43B 7/06 36/3 A |
| 2009/0126231 | A1 | 5/2009 | Malmivaara | |
| 2010/0077634 | A1 | 4/2010 | Bell | |
| 2010/0154256 | A1 | 6/2010 | Dua | |
| 2011/0197475 | A1 | 8/2011 | Weidl et al. | |
| 2011/0203137 | A1 * | 8/2011 | Long | A43B 5/12 36/91 |
| 2011/0258876 | A1 | 10/2011 | Baker et al. | |
| 2011/0302809 | A1 * | 12/2011 | Kim | A43B 13/127 36/103 |
| 2012/0023686 | A1 | 2/2012 | Huffa et al. | |
| 2012/0131818 | A1 | 5/2012 | Nishiwaki et al. | |
| 2012/0233882 | A1 | 9/2012 | Huffa et al. | |
| 2012/0240428 | A1 | 9/2012 | Knoll | |
| 2012/0255201 | A1 | 10/2012 | Little | |
| 2012/0260526 | A1 | 10/2012 | Smith et al. | |

FOREIGN PATENT DOCUMENTS

| | | |
|---|---|---|
| FR | 2697727 A3 | 5/1994 |
| JP | 09065908 | 3/1997 |
| JP | 2007190351 A | 8/2007 |

OTHER PUBLICATIONS

How to tie Tarahumara huaraches running sandals. Feel the World, Inc. Web. Dec. 30, 2014. Web. Retrieved Jan. 21, 2013. http://www.xeroshoes.com/tying.

International Search Report and Written Opinion in connection with International Application No. PCT/US2014/019542, dated Jun. 26, 2014.

International Search Report and Written Opinion in connection with International Application No. PCT/US2014/019548, dated Jun. 26, 2014.

Lloyd, Benjamin R., Industrial Designer, .PDF printout of web site regarding 1 Hour Cycling Shoe, www.benjaminrlloyd.com/industrialdesign/1-hour-cycling-shoe, 3 pages, printed on Mar. 25, 2013.

Advertisement from Etsy.com for "Crocheted Slippers Gladiator Home Sandals Mercerized Yarm Salmon Pink, Peach Orange Home Slippers Valentines Day Gift", 2 pages, printed on Mar. 25, 2013.

Jeffrey, Byron, Product & Fashion Designer, . PDF printout of web site depicting concept, rendering, sketch dated Nov. 22, 2012 by Mr. Bailey, byronjeffrey.com/55336/881326/portfolio/dior, 4 pages, printed on Mar. 25, 2013.

Jeffrey, Byron, Product & Fashion Designer, . PDF printout of web site depicting concept, rendering, sketch dated Nov. 22, 2012 by Mr. Bailey, 5 pages, 2013.

Advertisement from Etsy.com for "Crocheted Slippers Gladiator Home Sandals Mercerized Yarm Salmon Pink, Peach Orange Home Slippers Valentines Day Gift", 3 pages, 2013.

Lloyd, Benjamin R., Industrial Designer, .PDF printout of web site of 1 Hour Cycling Shoe, 2 pages, 2013.

* cited by examiner

ARTICLE OF FOOTWEAR WITH INTERCONNECTED TENSILE STRANDS

CROSS REFERENCE TO RELATED APPLICATIONS

This application is a Continuation of U.S. application Ser. No. 13/767,768, filed Feb. 14, 2013, the contents of which are hereby incorporated by reference in their entirety.

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a closure element (e.g., a shoelace, buckle, strap, etc.) to selectively adjust the fit of the footwear, as well as permitting entry and removal of the foot from the void within the upper. In addition, the upper may include a tongue that extends under the closure element to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

An article of footwear configured for wearing on a foot of a wearer is disclosed. The article of footwear is configured to support a closure element that selectively secures the article of footwear to the foot. The article of footwear includes an upper configured to receive the foot and configured to support the closure element. The upper includes a heel region that is configured to extend at least partially about a posterior of the heel. The upper additionally includes a medial side and a lateral side. The article of footwear also includes a sole structure that is fixed to the upper. Moreover, the article of footwear includes a longitudinal strand that extends along at least one of the medial side and the lateral side. Also, the article of footwear includes an underfoot strand that is coupled to the longitudinal strand and that extends across the sole structure to extend between the lateral side and the medial side of the upper. Furthermore, the article of footwear includes a closure strand that is coupled to the longitudinal strand. The closure strand is configured to couple to the closure element such that tensioning of the closure element tensions the longitudinal strand, the underfoot strand, and the closure strand to selectively secure the article of footwear to the foot.

Also, an article of footwear is disclosed that is configured for wearing on a foot of a wearer. The foot includes a heel. The article of footwear is configured to support a closure element that selectively secures the article of footwear to the foot. The article of footwear includes an upper configured to receive the foot. The upper includes a heel region that is configured to extend at least partially about a posterior of the heel. The upper additionally includes a medial side and a lateral side. Furthermore, the article of footwear includes a sole structure that is fixed to the upper. The sole structure includes a strand securement member with a medial extension that extends over the medial side of the upper and a lateral extension that extends over the lateral side of the upper. The article of footwear further includes a medial longitudinal strand that extends along the medial side of the upper and that is coupled to the medial extension of the strand securement member and the heel region. Moreover, the article of footwear includes a lateral longitudinal strand that extends along the lateral side of the upper and that is coupled to the lateral extension of the strand securement member and the heel region. Additionally, the article of footwear includes an underfoot strand that extends continuously between and alternately couples to the medial longitudinal strand and the lateral longitudinal strand. Furthermore, the article of footwear includes a medial closure strand that is coupled to the medial extension of the strand securement member and the medial longitudinal strand. The medial closure strand is configured to couple to the closure element. Still further, the article of footwear includes a lateral closure strand that is coupled to the lateral extension of the strand securement member and the lateral longitudinal strand. The lateral closure strand is configured to the couple to the closure element such that tensioning of the closure element tensions the medial and lateral longitudinal strands, the underfoot strand, and the medial and lateral closure strands to selectively secure the article of footwear to the foot.

Moreover, an article of footwear is disclosed that is configured for wearing on a foot of a wearer. The foot includes a heel, and the article of footwear includes an upper configured to receive the foot. The upper includes a heel region with a heel strap that is configured to extend at least partially about a posterior of the heel. The upper additionally includes a medial side and a lateral side. Furthermore, the article of footwear includes a closure element that is supported at the closure region. The closure element is configured to be tensioned to selectively secure the article of footwear to the foot. Additionally, the article of footwear includes a sole structure that is fixed to the upper. The sole structure includes a strand securement member with a medial extension that extends over the medial side of the upper and a lateral extension that extends over the lateral side of the upper. Also, the article of footwear includes a medial longitudinal strand that extends along the medial side of the upper and that is knotted to the medial extension of the strand securement member and that is knotted to the heel strap. The article of footwear additionally includes a lateral longitudinal strand that extends along the lateral side of the upper and that is knotted to the lateral extension of the strand securement member and the heel strap. Furthermore, the article of footwear includes an underfoot strand that extends continuously between and alternately turns over the medial longitudinal strand and the lateral longitudinal strand. Moreover, the article of footwear includes a medial closure strand that is fixed to the medial extension of the strand securement member and that is turned over the medial longitudinal strand. The medial closure strand is configured to turn over the closure element. Still further, the article of footwear includes a lateral closure strand that is fixed to the lateral extension of the strand securement member and that is turned over the lateral longitudinal strand. The lateral closure strand is configured to the turn over to the closure element such that tensioning of the closure element tensions the medial and lateral longitudinal strands, the underfoot strand, and the medial and lateral closure strands to selectively secure the article of footwear to the foot.

The advantages and features of novelty characterizing aspects of the present disclosure are pointed out with particularity in the appended claims. To gain an improved understanding of the advantages and features of novelty, however, reference may be made to the following descriptive matter and accompanying figures that describe and illustrate various configurations and concepts related to the present disclosure.

FIGURE DESCRIPTIONS

The foregoing Summary and the following Detailed Description will be better understood when read in conjunction with the accompanying figures.

DETAILED DESCRIPTION

Figure 1:
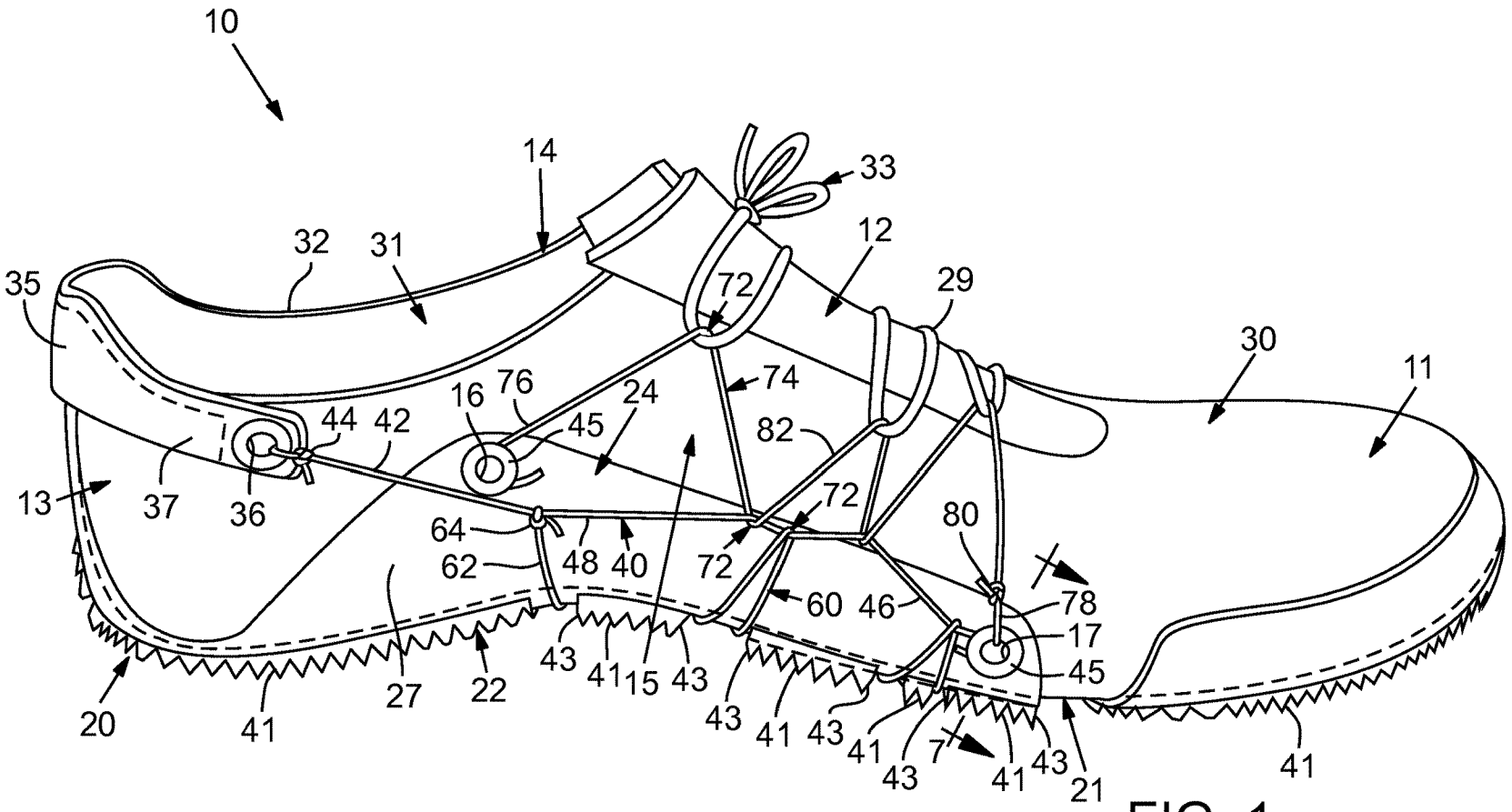
FIG. 1 is a perspective view of a medial side of an article of footwear according to exemplary embodiments of the present disclosure.

The following discussion and accompanying figures disclose various articles of footwear having uppers that include tensile strands (i.e., tensile strand elements) that operably couple closure elements, such as shoelaces, to other portions of the footwear. For instance, the tensile strands can operably couple the closure element to a sole structure and/or an ankle region of the footwear. The articles of footwear are disclosed, for purposes of example, as having configurations of running shoes. Concepts associated with the articles of footwear, including the uppers, may also be applied to a variety of other athletic footwear types, including basketball shoes, baseball shoes, cross-training shoes, cycling shoes, football shoes, tennis shoes, golf shoes, soccer shoes, walking shoes, hiking boots, ski and snowboard boots, and ice and roller skates, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

An article of footwear 10 is depicted in FIGS. 1-4 as including a sole structure 20 and an upper 30. Sole structure 20 is secured to a lower area of upper 30 and extends between upper 30 and the ground. Upper 30 provides a comfortable and secure covering for a foot of a wearer. As such, the foot may be located within a void 31 that is defined by the upper 30, and the upper 30 can effectively secure the foot within the footwear 10. The sole structure 20 extends under the foot to attenuate forces, enhance stability, or influence the motions of the foot, for example.

For purposes of reference in the following discussion, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone and areas surrounding the Achilles tendon (i.e., the posterior of the heel or ankle of the foot). Footwear 10 also includes a lateral side 14 (FIG. 2) and a medial side 15 (FIG. 1), which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 and to aid in the following discussion. In addition to footwear 10, regions 11-13 and sides 1415 may also be applied to sole structure 20, upper 30, and individual elements thereof.

Embodiments of Sole Structure

Figure 4:
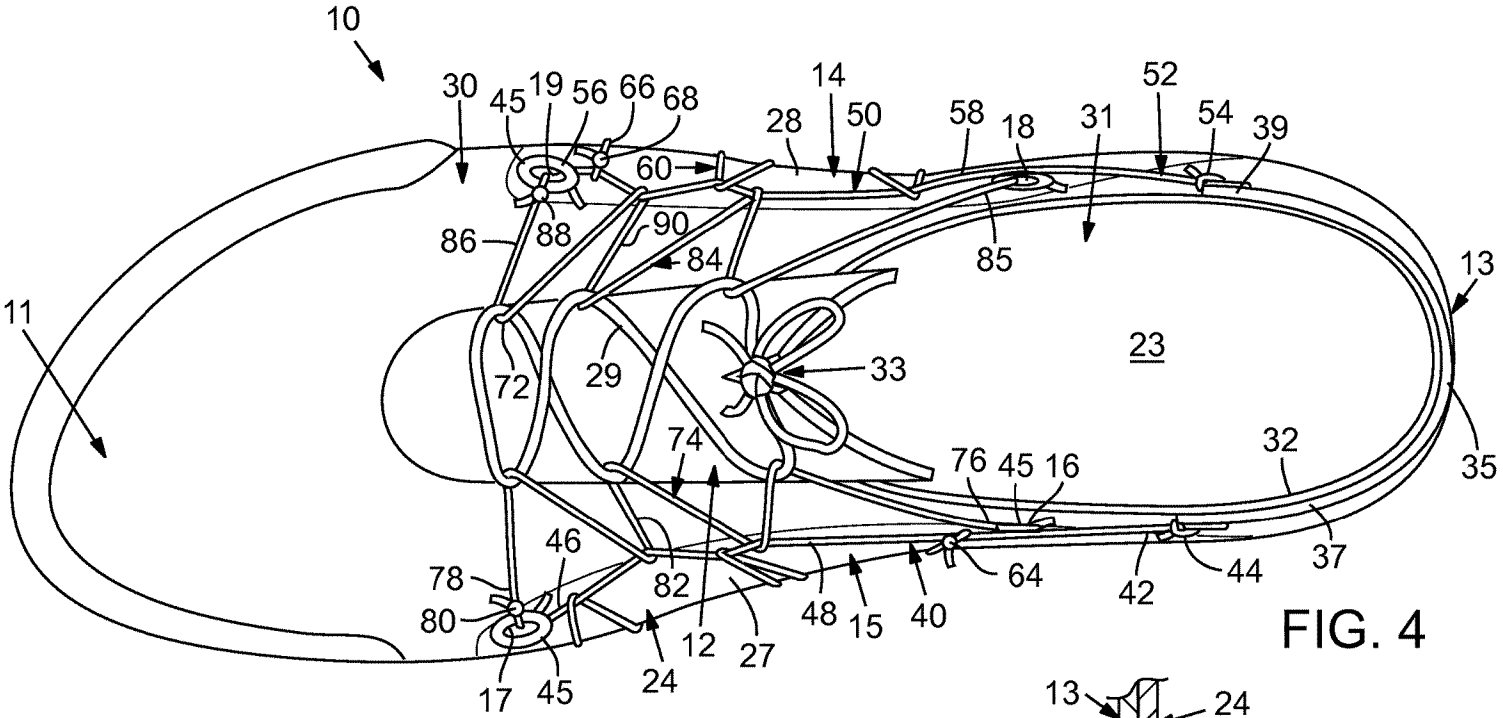
FIG. 4 is a top view of the article of footwear of FIG. 1.

Sole structure 20 can include a midsole 21, an outsole 22, and a sockliner 23 (FIG. 4). Midsole 21 can be fixedly secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber.

Figure 3:
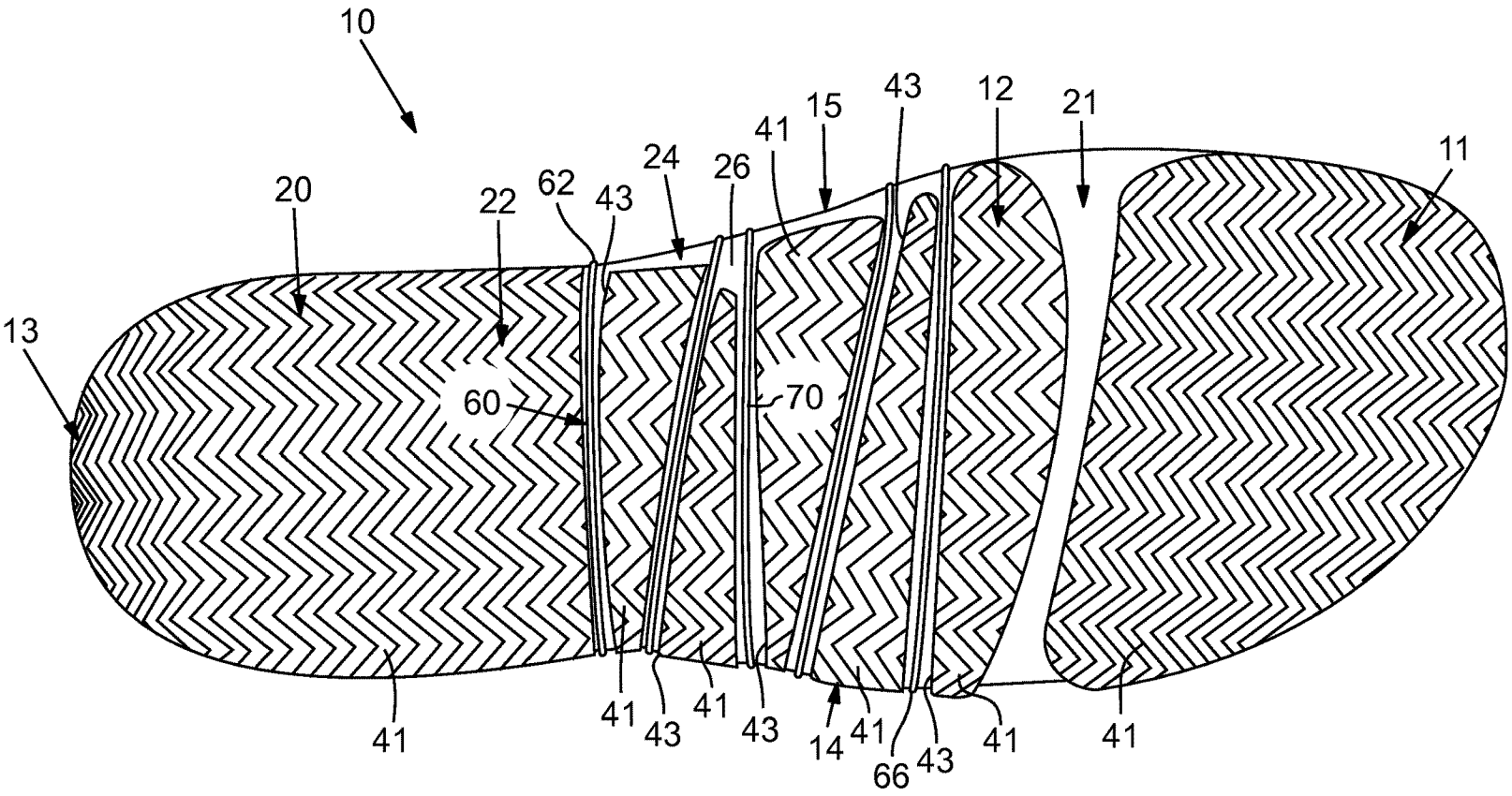
FIG. 3 is a bottom view of the article of footwear of FIG. 1.

Outsole 22 can be secured below the midsole 21 and may be formed from a wear-resistant polymeric (e.g., rubber) material that is textured to impart traction. In the illustrated embodiments, the outsole 22 can be collectively defined by a plurality of pads 41 (FIGS. 4 and 5) that are independent from each other and that are spaced apart in the longitudinal direction of the footwear 10. Spaces between the pads 41 can define respective tunnels 43 in the sole structure 20 as shown in FIG. 3. Each of the tunnels 43 can be axially straight and can extend continuously between the lateral side 14 and the medial side 15 of the footwear 10. It will be appreciated that the tunnels 43 are relatively open and exposed grooves in the embodiments illustrated; however, the tunnels 43 could be through-holes that extend transversely through the sole structure 20 in additional embodiments. The tunnels 43 could also be partially or fully defined by the midsole 21 in additional embodiments.

Sockliner 23 can be located within upper 30, as depicted in FIG. 4, and can be positioned to extend under a lower surface of the wearer's foot. Although this configuration for sole structure 20 provides an example of a sole structure 20 that may be used in connection with upper 30, a variety of other conventional or nonconventional configurations for sole structure 20 may also be utilized. Accordingly, the structure and features of sole structure 20 or any sole structure utilized with upper 30 may vary considerably.

Figure 5:
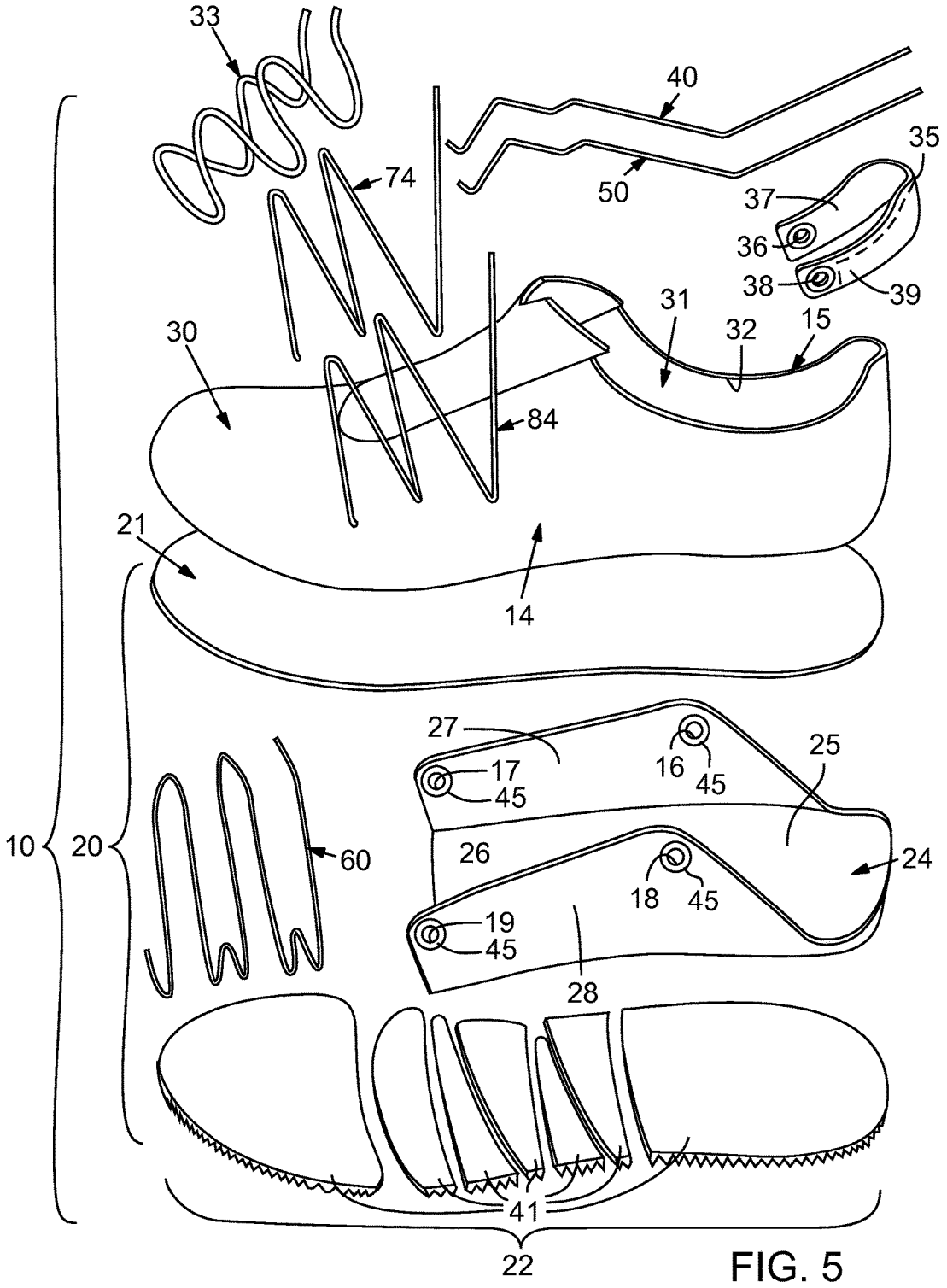
FIG. 5 is an exploded view of the article of footwear of FIG. 1.

The sole structure 20 can further include a strand securement member 24. As shown in FIG. 5, the strand securement member 24 can be a relatively thin sheet of flexible material (e.g., plastic) that defines a main body 25. The main body 25 can define an underfoot region 26, a medial extension 27, and a lateral extension 28. The underfoot region 26 can be at least partially embedded within the midfoot region 12 of the sole structure 20 so as to be layered between the outsole 22 and the midsole 21. As such, the underfoot region 26 can be disposed underneath the wearer's foot. The medial and lateral extensions 27, 28 can extend away from opposite sides of the underfoot region 26 and upward toward the upper 30. The strand securement member 24 can further include one or more holes, such as a medial rear hole 16, a medial forward hole 17, a lateral rear hole 18, and a lateral forward hole 19. Edges of the holes 16, 17, 18, 19 can be reinforced by a reinforcing member 45 (e.g., a grommet, etc.).

Embodiments of Upper

Upper 30 may be formed from a variety of sheet-like elements that are stitched, adhesively bonded, or otherwise joined together to define the void 31. The void 31 can be generally foot-shaped for receiving and securing the foot relative to sole structure 20. As such, upper 30 extends along the lateral side of the foot, along the medial side of the foot, over the foot, around a heel of the foot, and under the foot. Access to void 31 is provided by an ankle opening 32 located in at least heel region 13.

The upper 30 can be configured to support a closure element 33, such as a shoelace 29 that selectively secures the footwear 10 to the foot. The shoelace 29 can be flexible, but can have a substantially fixed length (i.e., substantially non-extendable in length), or the shoelace 29 can be resiliently elastic somewhat such that the shoelace 29 is resiliently extendable. Attachment of the shoelace 29 to the footwear 10 will be discussed in detail below. The shoelace 29 can be untied such that the upper 30 is relatively loose to allow the wearer's foot to be inserted into the footwear 10. Once inserted, the wearer can pull and tighten the shoelace 29 and can tie the shoelace 29 into a knot and/or bow to selectively secure the footwear 10 to the foot. Then, the shoelace 29 can be untied to re-loosen the footwear 10, facilitating removal of the foot from the void 31.

In the embodiments illustrated, the shoelace 29 is disposed generally at the top of the midfoot region 12 and zig-zags toward the forefoot region 11. However, it will be appreciated that the shoelace 29 could be disposed at another area of the upper 30. It will also be appreciated that the closure element 33 could include implements in addition to or instead of the shoelace 29. For instance, the closure element 33 can include a strap with pile tape (e.g., VELCRO™), a strap that buckles to a corresponding portion of the upper 30, a snap, a button, or other closure element 33. Also, in some embodiments, the closure element 33 could be an elongate, flexible wire that spools on a corresponding spool (not shown). This spool can selectively and automatically take up slack and tension the closure element 33, and in some embodiments, the closure element 33 can incorporate one or more lacing systems that are commercially available from Boa Technology of Denver, Colo.

Also, in the embodiments illustrated, the footwear 10 can include a heel strap 35. The heel strap 35 can be elongate and flexible and can include a first end 37 with a first hole 36 and a second end 39 with a second hole 38. Edges of the holes 36, 38 can be reinforced with a reinforcing member (e.g., a grommet) in some embodiments. The heel strap 35 can be disposed on and can extend across the heel region 13. Also, the heel strap 35 can be attached via adhesives, stitching, or any other suitable manner. As such, the first end 37 and the first hole 36 can be disposed on the medial side 15 of the upper 30, and the second end 39 and the second hole 38 can be disposed on the lateral side 14 of the upper 30.

In some configurations, upper 30 may also incorporate other elements, such as reinforcing members, aesthetic features, a heel counter that limits heel movement in heel region 13, and/or a wear-resistant toe guard located in forefoot region 11. The upper 30 can also include indicia (e.g., a trademark), a symbol, an image, or other visual features.

Embodiments of Tensile Strands

The article of footwear 10 can further include one or more strands 40, 50, 60, 74, 84 (tensile strand elements), each of which will be described in detail below. The strands 40, 50, 60, 74, 84 can be made from wire, string, cord, various flexible filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. An individual filament utilized in the strands 40, 50, 60, 74, 84 may be formed form a single material (i.e., a monocomponent filament) or from multiple materials (i.e., a bicomponent filament). Similarly, different filaments may be formed from different materials. As an example, yarns utilized as strands 40, 50, 60, 74, 84 may include filaments that are each formed from a common material, may include filaments that are each formed from two or more different materials, or may include filaments that are each formed from two or more different materials. Similar concepts also apply to threads, cables, ropes, etc. The thickness (diameter) of strands 40, 50, 60, 74, 84 can be within a range from approximately 0.03 millimeters to 5 millimeters, for example. Also, the strands 40, 50, 60, 74, 84 can have a substantially circular cross section, an ovate cross section, or a cross section of any other suitable shape.

As an example, one or more of the strands 40, 50, 60, 74, 84 may be formed from a bonded nylon 6.6 with a breaking or tensile strength of 3.1 kilograms and a weight of 45 tex. One or more strands 40, 50, 60, 74, 84 may be formed from a bonded nylon 6.6 with a breaking or tensile strength of 6.2 kilograms and a tex of 45. As a further example, one or more strands 40, 50, 60, 74, 84 may have an outer sheath that sheathes and protects an inner core.

In some embodiments, at least one of the strands 40, 50, 60, 74, 84 can have a fixed length (e.g., can be nonextendible). Also in some embodiments, at least one of the strands 40, 50, 60, 74, 84 can be resiliently extendible. Some of the strands 40, 50, 60, 74, 84 can be nonextendible while others can be extendible in various embodiments as well.

In the embodiments illustrated, the strands 40, 50, 74, 84 extend over and across respective portions of the upper 30, and the strand 60 extends across and through the sole structure 20 between the medial and lateral sides 14, 15 of the footwear 10. Also, the strands 40, 50, 60, 74, 84 can be interconnected together (similar to a web) and coupled with respective portions of the upper 30, the sole structure 20, and the shoelace 29 as will be described in detail. As will be discussed, two or more of the strands 40, 50, 60, 74, 84 can be interconnected together by turning over each other one or more times, by being tied or otherwise knotted together, via fasteners, or in another suitable fashion. Also, the strands 40, 50, 60, 74, 84 can be attached to respective portions of the upper 30 and/or the sole structure 20 via adhesives, via fasteners, by knots, or in another suitable fashion. Thus, as will be appreciated, the strands 40, 50, 60, 74, 84 can secure the footwear 10 to the wearer's foot, and the strands 40, 50, 60, 74, 84 can improve comfort and performance of the footwear 10.

It is noted that although the strands 40, 50, 60, 74, 84 are exposed from outside the footwear 10 in the embodiments shown, one or more of the strands 40, 50, 60, 74, 84 could be at least partially embedded or otherwise hidden from outside the footwear 10. For instance, in some embodiments, the upper 30 could include an outer layer that covers over the strands 40, 50, 60, 74, 84. Also, in some embodiments, the upper 30 could include inner and outer layers, and the strands 40, 50, 60, 74, 84 could be embedded between those layers. Moreover, in some embodiments, the strand 60 could be embedded within the sole structure 20.

Figure 2:
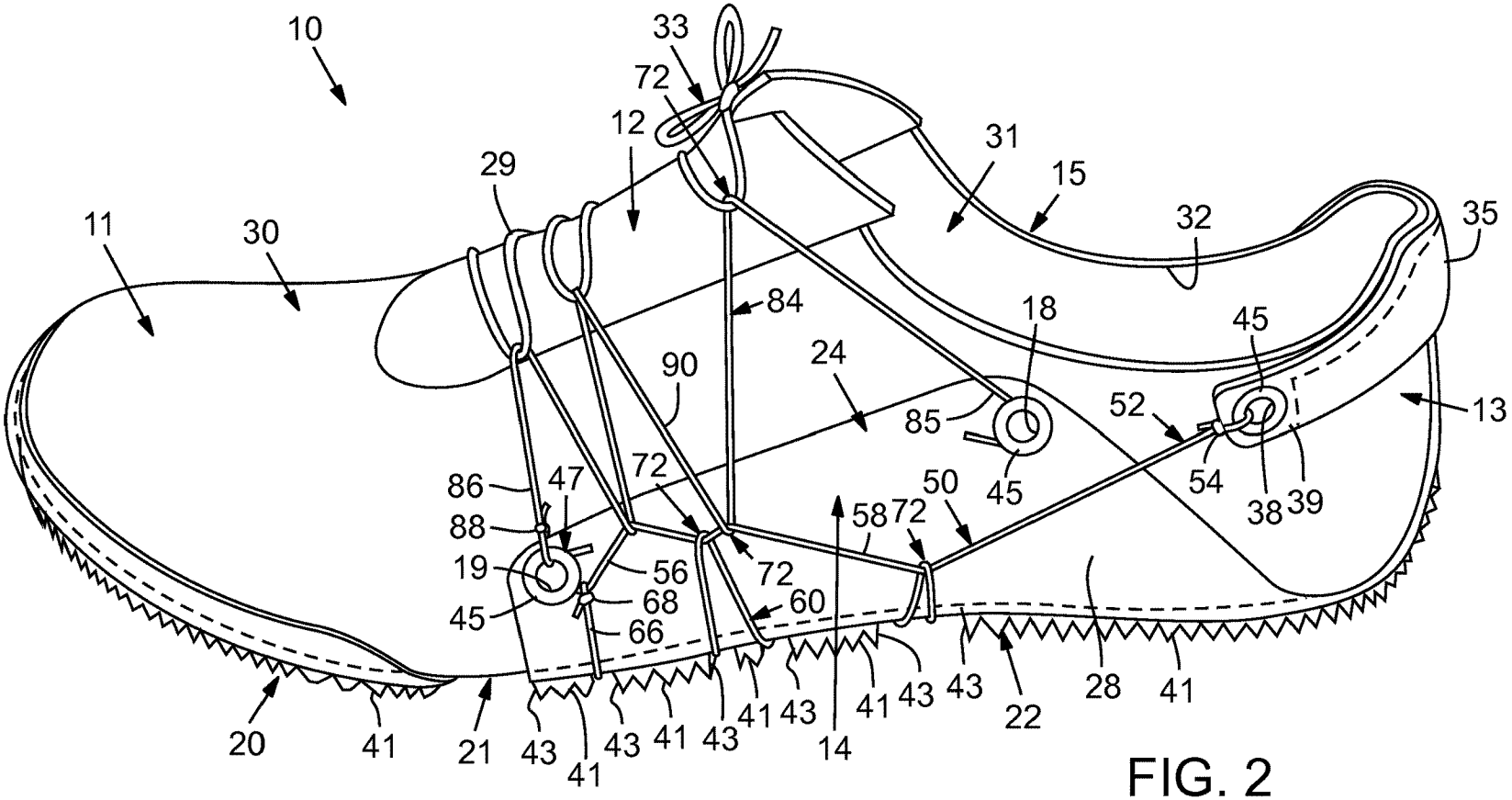
FIG. 2 is a perspective view of a lateral side of the article of footwear of FIG. 1.

For instance, as shown in FIGS. 1, 2 and 4, the footwear 10 can include at least one longitudinal strand 40, 50, which extends generally longitudinally (e.g., generally along the longitudinal axis of the footwear 10). In the embodiments illustrated, the footwear 10 includes a medial longitudinal strand 40 (FIGS. 1 and 4), which extends along the medial side 15, and a lateral longitudinal strand 50 (FIGS. 2 and 4), which extends along the lateral side 14.

Figure 7:
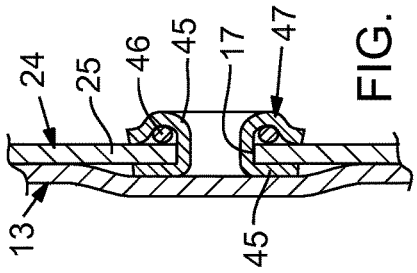
FIG. 7 is a section view of a crimped coupling of the article of footwear taken along the line 7-7 of FIG. 1.

More specifically, the medial longitudinal strand 40 includes a first end 42 that is looped through the hole 36 in the first end 37 of the heel strap 35 and that is fixed to the heel strap 35 via a knot 44. In additional embodiments, the strand 40 is attached to the heel strap 35 via a fastener, adhesives, or in another fashion. The medial longitudinal strand 40 also includes a second end 46 that is coupled (e.g., fixed) to the strand securement member 24, adjacent the hole 17. For instance, as shown in FIG. 7, the second end 46 can attached to the strand securement member 24 via a crimped coupling (generally indicated at 47 in FIG. 7). More specifically, the second end 46 can be wrapped about the hole 17 and fixedly crimped or pinched between the reinforcing member 45 and the main body 25 of the strand securement member 24. The second end 46 can be otherwise attached to the strand securement member, such as through adhesives, fasteners, and the like. The medial longitudinal strand 40 can further include a middle portion 48 between the first and second ends 42, 46 that extends along the medial side 15 of the upper 30 so as to provide areas of attachment for other strands 60, 74 as will be described.

The footwear 10 can also include a lateral longitudinal strand 50. More specifically, the lateral longitudinal strand 50 includes a first end 52 that is looped through the hole 38 in the second end 39 of the heel strap 35 and that is fixed to the heel strap 35 via a knot 54. The lateral longitudinal strand 50 also includes a second end 56 that is coupled (e.g., fixed) to the strand securement member 24, adjacent the hole 19 by a crimped coupling 47 of the type shown in FIG. 7. The lateral longitudinal strand 50 can further include a middle portion 58 between the first and second ends 52, 56 that extends along the lateral side 14 of the upper 30 so as to provide areas of attachment for other strands 60, 84 as will be described.

It will be appreciated that, in additional embodiments, the footwear 10 can include a single, continuous longitudinal strand that extends between the medial and lateral sides 14, 15. For instance, one end of the strand could be fixed at the hole 17, across the medial side 15, around the heel region 13, across the lateral side 14, and the opposite end of the strand could be fixed at the hole 19.

The footwear 10 can additionally include an underfoot strand 60 with a first end 62 (FIG. 1) that is coupled to the medial longitudinal strand 40. For instance, the first end 62 can include a knot 64 that fixes the first end 62 to the medial longitudinal strand 40. The knot 64 can be disposed adjacent the hole 16 in the strand securement member 24. The underfoot strand 64 can also include a second end 66 that is coupled to the lateral longitudinal strand 50. The second end 66 can include a knot 68 that fixes the second end 66 to the lateral longitudinal strand 50. The underfoot strand 60 can further include a middle portion 70, which extends continuously between and which alternates between (i.e., zig-zag between) the medial and lateral sides 14, 15 of the footwear 10.

Figure 6:
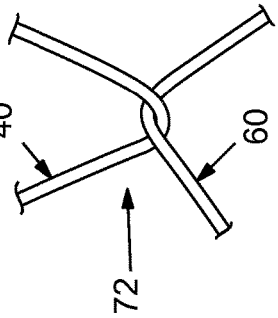
FIG. 6 is a perspective view of an exemplary turn of strands of the article of footwear of FIG. 1.

The middle portion 70 can be coupled to the medial longitudinal strand 40. For instance, as shown in FIGS. 1 and 6, the middle portion 70 can criss-cross with (i.e., turn over) the medial longitudinal strand 40 so as to define a turn (indicated at 72). The turn 72 can be a single turn as shown, or the turn 72 can be a plural turn. Also, the middle portion 70 can be coupled to the medial longitudinal strand 40 at plural (e.g., two) turns 72 as shown in FIG. 1. The middle portion 70 can similarly turn over the lateral longitudinal strand 40 at one or more (e.g., two) turns 72 as shown in FIG. 2. Furthermore, as shown in FIG. 3, the middle portion 70 can extend through and can be received in one or more of the tunnels 43 of the sole structure 20. With each turn 72, the middle portion 70 can extend through a different tunnel 43. Thus, the underfoot strand 60 can extend downward from the knot 64 (FIG. 1), through the rearmost tunnel 43 (FIG. 3), to the lateral side 14, upwards to turn over the lateral longitudinal strand 50, back downward, to the second most rearward tunnel 43, to the medial side 15, upwards to turn over the medial longitudinal strand 40, back downward, to the third most rearward tunnel 43, to the lateral side 14, upward to turn over the lateral longitudinal strand 50, and so forth until the underfoot strand 60 fixes to the lateral longitudinal strand 50 at the knot 68 (FIG. 2).

Moreover, the footwear 10 can include a medial closure strand 74 (FIGS. 1 and 4). The medial closure strand 74 can include a first end 76 that is coupled to the strand securement member 24, adjacent the hole 16 (e.g., via a crimped coupling 47 of the type shown in FIG. 7) at a first location. The medial closure strand 74 can also include a second end 78 that is coupled to (e.g., fixed) to the strand securement member 24, adjacent to the hole 17 (e.g., via a knot 80) at a second location. The medial closure strand 74 can further include a middle portion 82 that continuously extends between and that alternately couples to the shoelace 29 and the medial longitudinal strand 40. For instance, the middle portion 82 can turn over the shoelace 29 at one or more (e.g., three) locations (at closure turn(s) 72 of the type shown in FIG. 6). The middle portion 82 can similarly turn over the medial longitudinal strand 40 at one or more (e.g., two) locations (at longitudinal turn(s) 72). Thus, the medial closure strand 74 can extend continuously from the hole 16, upward to turn over the shoelace 29, downward to turn over the medial longitudinal strand 40, back upward to turn over the shoelace 29, back downward to turn over the medial longitudinal strand 40, back upward to turn over the shoelace 29, and downward to attach to the strand securement member 24 via the knot 80.

The footwear 10 can similarly include a lateral closure strand 84 (FIGS. 2 and 4). The lateral closure strand 84 can include a first end 85 that is coupled to the strand securement member 24, adjacent the hole 18 (e.g., via a crimped coupling 47 of the type shown in FIG. 7). The lateral closure strand 84 can also include a second end 86 that is coupled to (e.g., fixed) to the strand securement member 24, adjacent to the hole 19 (e.g., via a knot 88). The lateral closure strand 84 can further include a middle portion 90 that continuously extends between and that alternately couples to the shoelace 29 and the lateral longitudinal strand 50. For instance, the middle portion 90 can turn over the shoelace 29 at one or more (e.g., three) locations (at turn(s) 72 of the type shown in FIG. 6). The middle portion 90 can similarly turn over the lateral longitudinal strand 50 at one or more (e.g., two) locations (at turn(s) 72). Thus, the lateral closure strand 84 can extend continuously from the hole 18, upward to turn over the shoelace 29, downward to turn over the lateral longitudinal strand 50, back upward to turn over the shoelace 29, back downward to turn over the lateral longitudinal strand 50, back upward to turn over the shoelace 29, and downward to attach to the strand securement member 24 via the knot 88.

Accordingly, after the wearer has inserted his or her foot into the upper 30, the wearer can tension and tighten the shoelace 29. This, in turn, can pull and tension the medial and lateral closure strands 74, 84. As a result, the medial and lateral longitudinal strands 40, 50 can be pulled and tensioned to pull the heel strap 35 (and, generally, the heel region 13) inward against the wearer's Achilles heel. As another result, the underfoot strand 60 can be tensioned to pull the sole structure 20 upward toward the bottom of the wearer's foot. The shoelace 29 can be additionally knotted, bowed, clamped, or otherwise fixed in this tensioned condition such that the upper 30 and sole structure 20 remain tightly secured to the foot. Furthermore, flexion of the foot can increase tension in one or more of the straps 40, 50, 60, 74, 84, causing tensioning of the other straps 40, 50, 60, 74, 84. Thus, the footwear 10 can have a so-called "active fit," whereby movement of the foot causes the footwear 10 to flex toward and secure more tightly to the foot. As a result, the footwear 10 can provide ample support while worn running, cutting, pivoting, etc.

It will be appreciated that the strands 40, 50, 60, 74, 84 can vary from the illustrated embodiments without departing from the scope of the present disclosure. For instance, in some embodiments, the underfoot strand 60 can be fixed to the strand securement member 24. For instance, the middle portion 70 could be bonded to the member 24. Also, the middle portion 70 could be attached to the member 24 via bonded textiles, adhesives, via ultrasonic welding, etc. Also, in some embodiments, the longitudinal length of the strands 40, 50, 60, 74, 84 could be adjustable in some embodiments. For instance, one or more of the strands 40, 50, 60, 74, 84 can be coupled to a clamp, spool, or similar device that selectively shortens and/or lengthens the strand 40, 50, 60, 74, 84.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear including a sole structure, the article of footwear comprising:

a forefoot region;

a heel region opposite the forefoot region;

a medial side extending from the forefoot region to the heel region;

a lateral side opposite the medial side and extending from the forefoot region to the heel region;

a closure element configured to secure the article of footwear to a foot;

a first longitudinal strand disposed on one of the medial side and the lateral side and extending between a first end located proximate to the forefoot region and a second end located proximate to the heel region;

a second longitudinal strand disposed on the other of the medial side and the lateral side and extending between a first end located proximate to the forefoot region and a second end located proximate to the heel region; and an underfoot strand including a first segment extending through the sole structure from a first position coupled to the first longitudinal strand to a second position coupled to the second longitudinal strand, and a second segment extending from the second position coupled to the second longitudinal strand, through the sole structure, to a third position coupled to the first longitudinal strand.

2. The article of footwear of claim 1, wherein the first end of the first longitudinal strand and the first end of the second longitudinal strand are coupled to a securement member and the second end of the first longitudinal strand and the second end of the second longitudinal strand are coupled to a heel strap.

3. The article of footwear of claim 1, wherein tensioning the closure element urges the first end of the first longitudinal strand toward the second end of the first longitudinal strand.

4. The article of footwear of claim 3, wherein tensioning the closure element urges the first end of the second longitudinal strand toward the second end of the second longitudinal strand.

5. The article of footwear of claim 1, further comprising:

a first closure strand having a first end and a second end and extending continuously between the first end and the second end of the first closure strand and between the closure element and the first longitudinal strand, the first closure strand contacting the closure element at more than one location along a length of the first closure strand; and a second closure strand having a first end and a second end and extending continuously between the first end and the second end of the second closure strand and between the closure element and the second longitudinal strand, the second closure strand contacting the closure element at more than one location along a length of the second closure strand.

6. The article of footwear of claim 5, wherein tensioning of the closure element tensions the first longitudinal strand, the second longitudinal strand, and the underfoot strand.

7. The article of footwear of claim 5, wherein the first end of the first closure strand is coupled to a first location of the article of footwear and the second end of the first closure strand is coupled to a second location of the article of footwear, the first location disposed between the forefoot region and the heel region and the second location disposed between the first location and the heel region.

8. The article of footwear of claim 7, wherein the first end of the first longitudinal strand is coupled to the first location of the article of footwear and the second end of the first longitudinal strand is coupled to a third location of the article of footwear.

9. The article of footwear of claim 8, wherein the second location is disposed between the first location and the third location in a direction extending between the forefoot region and the heel region.

10. The article of footwear of claim 8, wherein the first location and the second location are disposed on a strand securement member and the third location is disposed on a heel strap.

11. An article of footwear including a sole structure, the sole structure having an underfoot region, the article of footwear comprising:

a forefoot region;

a heel region opposite the forefoot region;

a medial side extending from the forefoot region to the heel region;

a lateral side opposite the medial side and extending from the forefoot region to the heel region;

a closure element configured to secure the article of footwear to a foot;

a first longitudinal strand disposed on one of the medial side and the lateral side and extending between a first end located proximate to the forefoot region and a second end located proximate to the heel region;

a second longitudinal strand disposed on the other of the medial side and the lateral side and extending between a first end located proximate to the forefoot region and a second end located proximate to the heel region; and an underfoot strand including a first segment extending across the underfoot region of the sole structure from a first position coupled to the first longitudinal strand to a second position coupled to the second longitudinal strand, and a second segment extending from the second position coupled to the second longitudinal strand, across the underfoot region of the sole structure, to a third position coupled to the first longitudinal strand, the first segment and the second segment being part of a same, unitary strand.

12. The article of footwear of claim 11, wherein the first end of the first longitudinal strand and the first end of the second longitudinal strand are coupled to a securement member and the second end of the first longitudinal strand and the second end of the second longitudinal strand are coupled to a heel strap.

13. The article of footwear of claim 11, wherein tensioning the closure element urges the first end of the first longitudinal strand toward the second end of the first longitudinal strand.

14. The article of footwear of claim 11, wherein tensioning the closure element urges the first end of the second longitudinal strand toward the second end of the second longitudinal strand.

15. The article of footwear of claim 11, further comprising:

a first closure strand having a first end and a second end and extending continuously between the first end and the second end of the first closure strand and between the closure element and the first longitudinal strand, the first closure strand contacting the closure element at more than one location along a length of the first closure strand; and a second closure strand extending continuously between a first end and a second end of the second closure strand and between the closure element and the second longitudinal strand, the second closure strand contacting the closure element at more than one location along a length of the second closure strand.

16. The article of footwear of claim 15, wherein tensioning of the closure element tensions the first longitudinal strand, the second longitudinal strand, and the underfoot strand.

17. The article of footwear of claim 15, wherein the first end of the first closure strand is coupled to a first location of the article of footwear and the second end of the first closure strand is coupled to a second location of the article of footwear, the first location disposed between the forefoot region and the heel region and the second location disposed between the first location and the heel region.

18. The article of footwear of claim 17, wherein the first end of the first longitudinal strand is coupled to the first location of the article of footwear and the second end of the first longitudinal strand is coupled to a third location of the article of footwear.

19. The article of footwear of claim 18, wherein the second location is disposed between the first location and the third location in a direction extending between the forefoot region and the heel region.

20. The article of footwear of claim 18, wherein the first location and the second location are disposed on a strand securement member and the third location is disposed on a heel strap.

* * * * *